United States Patent [19]

Bolaños

[11] 4,120,227

[45] Oct. 17, 1978

[54] GUITAR WITH KEYBOARD PLUCKING MEANS

[76] Inventor: Jaime A. Bolaños, Edif. F.G. la Diagonal No. 424, San Salvador, El Salvador

[21] Appl. No.: 821,843

[22] Filed: Aug. 4, 1977

[51] Int. Cl.[2] ..... G10D 3/16

[52] U.S. Cl. ..... 84/320; 84/258

[58] Field of Search ..... 84/320, 321, 258

[56] References Cited

U.S. PATENT DOCUMENTS

| | | | |
|---|---|---|---|
| 984,176 | 2/1911 | Zewdoon | 84/320 |
| 3,453,922 | 7/1969 | O'Brien | 84/258 |

FOREIGN PATENT DOCUMENTS

| | | | |
|---|---|---|---|
| 682,858 | 11/1952 | United Kingdom | 84/258 |

*Primary Examiner*—L. T. Hix
*Assistant Examiner*—Benjamin R. Fuller
*Attorney, Agent, or Firm*—Townsend and Townsend

[57] ABSTRACT

A multiple string guitar-like instrument has a plurality of plucking means mounted to confront playing strings. Each plucking means comprises a housing having a carriage guide, a carriage disposed for movement transverse to the string, a finger pivotally mounted to the carriage, a cam pivotally mounted to the housing, and a follower pin extending laterally from the finger for tracking the contour of the cam to direct the finger to move in an eccentric path. The plucking mechanism is disposed at a distance from the string so that the head of the moving finger plucks the string at an oblique angle during only a driven portion of a keying stroke.

7 Claims, 12 Drawing Figures

GUITAR WITH KEYBOARD PLUCKING MEANS

BACKGROUND OF THE INVENTION

The present invention relates to a plucking means and specifically to a plectrum for actuating the strings of a guitar-like instrument.

A conventional guitar is plucked by hand or with a handheld device called a plectrum to produce a distinctive musical sound. The guitar in its classical conception is a musical instrument which has six strings tightly strung over a wooden body forming a sounding board.

The present invention is in a guitar-like instrument having 25 or more strings drawn across a wooden resonating body and tuned to a standard piano scale.

A mechanism was needed to actuate the strings in a manner simulating the sound of a guitar. However, the striking mechanism of a piano is unsuited to such a guitar-like instrument, since the sound so produced is characteristically distinct from the sound of a guitar plectrum. Moreover, while various plectrum apparatus are known to the art, for example, U.S. Pat. No. 3,453,922, to O'Brien, which relates to a plectrum for a harpsicord, the particular combination of features herein disclosed provides the desired movement to more accurately simulate the distinctive guitar sound.

SUMMARY OF THE INVENTION

A multiple string guitar-like instrument has a plurality of plucking mechanisms mounted to confront playing strings. The plucking means are mounted in an array on a support confronting the strings. Each plucking means comprises a housing having a carriage guide, a carriage disposed for movement within the carriage guide and transverse to the string, a finger pivotally mounted to the carriage, a cam pivotally mounted to the housing, and a follower pin extending laterally from the finger for tracking the contour of the cam to direct the finger to move in an eccentric path. The plucking mechanism is disposed at a distance from the string so that the head of the moving finger plucks the string at an oblique angle during only a driven portion of a keying stroke.

One of the advantages of this invention is that a person trained to play a piano can use the inventive instrument to simulate the sounds of the classical guitar. In fact, the instrument may be played with the same precision as a piano. Moreover, the instrumentalist may produce, with relative ease, a number of chords and note combinations which are impossible to create on the classical guitar, yet the musical sound so produced would be that of a classical guitar.

Another advantage of the structure herein described is that each plucking mechanism is self-contained and is independent in operation of all other like mechanisms. This minimizes the problem of adjustment and replacement, should such become necessary.

Moreover, the device is inexpensive, easily serviced and readily adjusted. Other advantages of the invention will be apparent upon a detailed examination of the invention as it is herein described.

BRIEF DESCRIPTION OF THE DRAWINGS

The invention will be best understood by reference to the following detailed description taken in conjunction with the accompanying drawings in which.

DETAILED DESCRIPTION OF THE PREFERRED EMBODIMENTS

Figure 1:
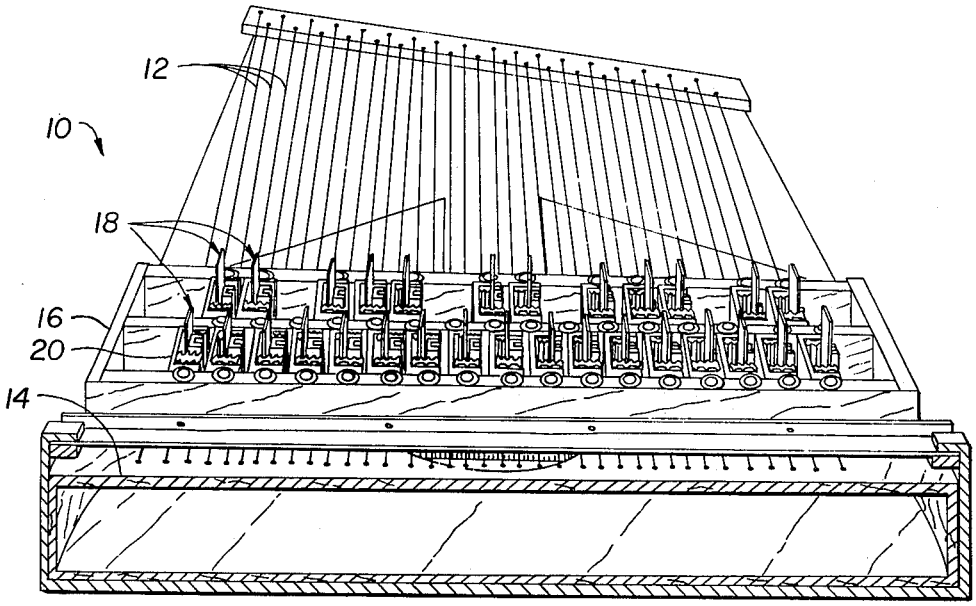
FIG. 1 is a top perspective view and partial cutaway of a stringed guitar-like instrument incorporating the invention.

FIG. 1 illustrates a musical instrument 10 incorporating the invention. The instrument 10 resembles a guitar having a plurality of strings 12 strung across a hollow wooden body 14 forming resonating chamber. A manifold 16 having a plurality of plucking mechanisms or plectrums 18 arranged in an array is mounted so that the movement of the plectrum 18 is transverse to the strings 12 across the body 14. The strings 12 may be tuned to the conventional half tone musical scale.

Figure 2:
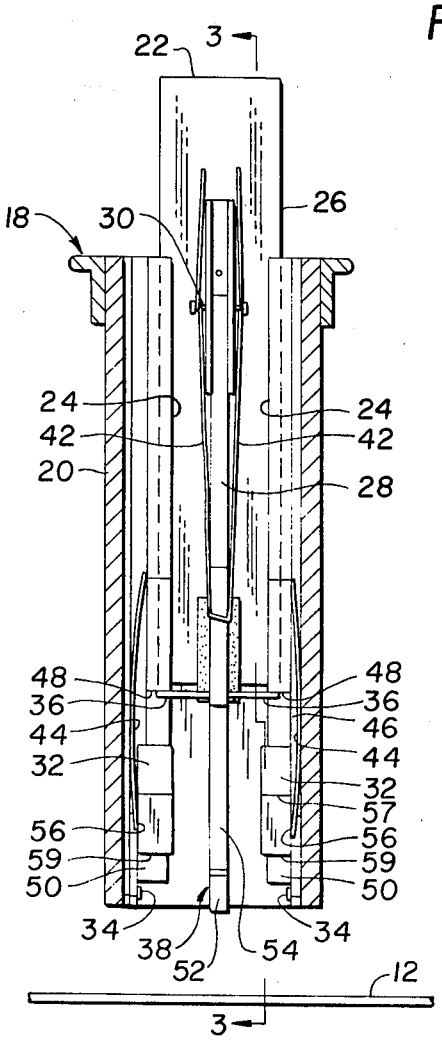
FIG. 2 is a front plan view of a first preferred embodiment of a single plectrum means according to the invention.

Referring to FIG. 2, one plectrum 18 corresponds with each string 12. Each plectrum 18 is self-contained in an individual housing 20 and has a reciprocatory key 22 which extends away from the string 12 in a position readily accessible to an instrumentalist. Other features of the plectrum 18 are a carriage guide 24, a carriage 26 (which may be an extension of the key 22) which is mounted for reciprocatory movement in the carriage guide 24, a finger 28 pivotally mounted at a hinge 30 to the carriage 26, a cam or pair of cams 32, pivotally mounted at a hinge or hinges 34 to the housing 20, and a follower pin 36 on the finger 28 and which extends laterally therefrom.

At the end of finger 28, which is normally linear, is an obliquely disposed head 38 with a felt or like pliant pad secured thereto. The angle of the head 38 is such that the heel of the head is laterally further from the carriage than the tip of the head.

Figure 3:
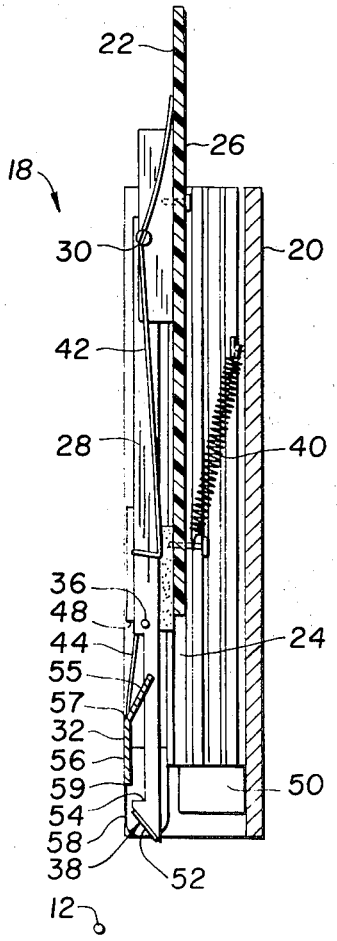
FIG. 3 is a side cross-sectional view of the plectrum means in a first position.

Referring to FIGS. 2 and 3, further details of the plectrum 18 are shown, including a number of spring mechanisms to bias the positioning of the various moving parts. For example, a return spring 40 is connected between the carriage 26 and housing 20 to assure that the carriage 26 returns to its correct position after each stroke. The finger 28 is hinged to move between a first position resting against carriage 26 and a second position wherein the head 38 is laterally displaced from the rest position. A leaf spring 42 may be provided at the hinge to assure that the finger 28 returns to the rest position. The cam 32 is a thin leaf bent to form a ramp portion 55 and a runway 56 on either side of an apex 57. Runway portion 56 adjoins a backing plate 58 which is coupled to housing 20 through hinge 34. Runway portion also includes an edge 59 over which pin 36 may pass, whereby spring 42 returns finger 28 to its rest position against carriage 26. The cam 32 also includes a bias spring 44 which holds the cam 32 in a rest position against a stop 46 on the top surface of the carriage guide 24. The carriage guide 24 also includes a pin stop 48 for each pin 36. The pin stop 48 may be disposed along the margin of the housing 20 extending laterally from carriage guide 26 so as to confront the pin 36 in its return path. The plectrum 18 may also inclue a rubber pad 50 at the end of the carriage guide 24 for cushioning the carriage 26 at the bottom of its key stroke.

Between the head 38 and the location of the pin 36, the finger 28 includes a recessed neck 54. The recessed neck 54 provides space allowing string 12 to vibrate freely after having been plucked by head 38.

Figure 4:
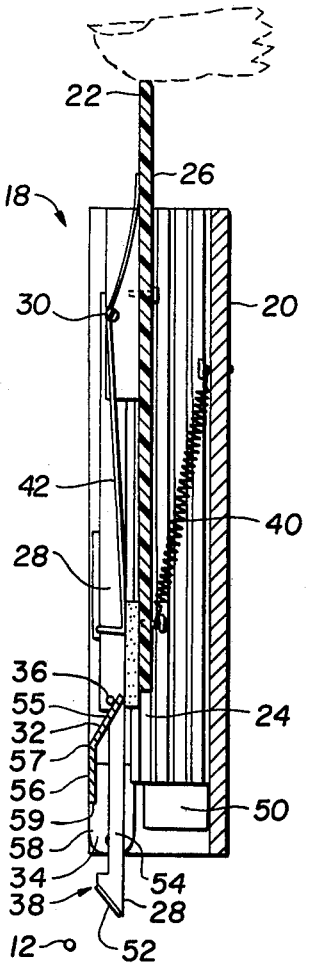
FIG. 4 is a side cross-sectional view of the plectrum means in a second position.

Having explained the basic structure of the invention, FIGS. 3, 4, 5 and 6 illustrate one operation cycle. According to the invention, the cam 32 is disposed to intercept the pin 36 upon a finger moving key stroke laterally displacing the end or head 38 of the finger 28 to pluck string 12. On the return stroke the head 38 drops laterally away from string 12 so that string 12 may vibrate freely. In the illustrative examples, beginning with FIG. 3, the key 22 and the carriage 26 are in a rest position, the key 22 being fully extended so that the finger 28 rests against the carriage 26. In FIG. 4, the key 22 is shown depressed to begin advance of the carriage 26 along the carriage guide 24.

Figure 5:
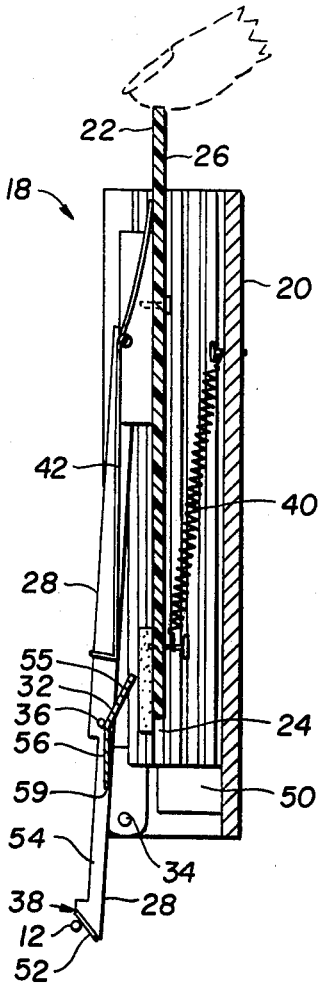
FIG. 5 is a side cross-sectional view of the plectrum means in a third position.

As pin 36 encounters ramp portion 55, finger 28 is urged laterally away from carriage 26. In FIG. 5, pin 36 is at apex 57 and head 38 is proximate spring 12. The plectrum 18 is disposed so that head 38 encounters spring 12 while pin 36 is within the length of runway portion 56 (FIG. 5). When string 12 is encountered by head 38, string 12 is displaced according to the movement of the finger 28 until the force of the string exceeds the opposing friction force of head 38, whereupon string 12 slips past head 38 into the area of recessed neck 54 permitting string 12 to vibrate freely.

Figure 6:
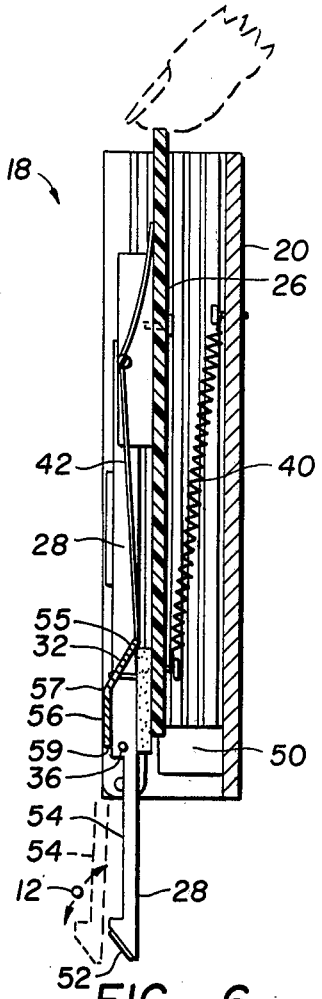
FIG. 6 is a side cross-sectional view of the plectrum means in a fourth position.

Referring to FIG. 6, it is seen that the finger 28 falls away from string 12 when pin 36 reaches the end of runway portion 56. This allows the string 12 to vibrate freely and permits the finger 28 to be withdrawn past string 12 in a return path toward the rest position (FIG. 3). In the return path (FIG. 6 to FIG. 3), pin 36 encounters the underside of the ramp portion 55 of cam 32. However, cam 32, being pivotaly attached at hinge 34, is urged out of the return path by the pin 36. As the pin 36 drops past the cam 32, the cam 32 immediately recovers to its rest position by bias on spring 44 so that cam 32 is in position to intercept pin 34 during a subsequent key stroke.

FIGS. 7 through 12 illustrate a second preferred embodiment of the invention. For convenience reference numerals refer to features analogous with the first embodiment.

Figure 7:
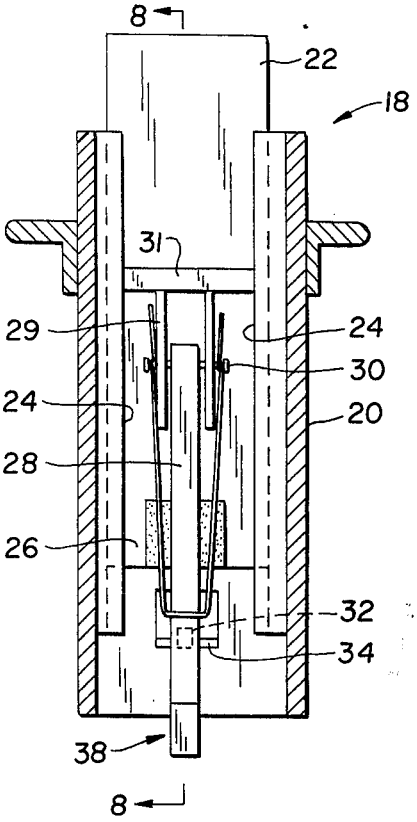
FIG. 7 is a front elevational view in partial cross section of a second preferred embodiment.
Figure 8:
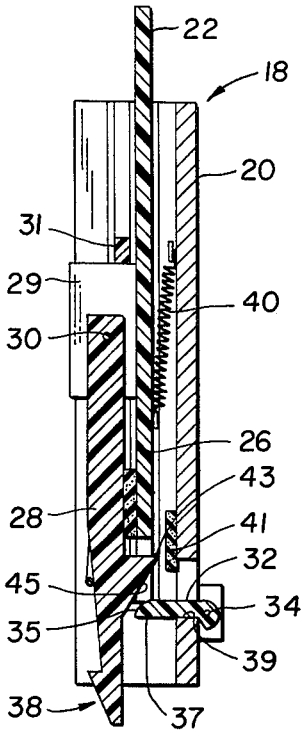
FIG. 8 is a side cross-sectional view of the second embodiment in a first position.

Referring to FIGS. 7 and 8, each plectrum 18 includes a housing 20, reciprocatory key 22, carriage guide 24, carriage 26, a pivotally mounted finger 28 with a hinge 30, and a cam 32 mounted on a hinge 34 directly beneath finger 28. In the embodiment of FIGS. 7 and 8, the finger 28 is mounted to an outwardly extending bracket 28 and is relatively firmly biased against the carriage. A cross piece 31 is provided between sides of carriage guide 24. The bracket 29 and cross piece 31 cooperate to serve as a return stop for the carriage 26.

The pivotal cam 32 comprises an arm having at one tip a rounded or tapered face 35 on one side and a flat face 37 on the other side parallel to the axis of pivot 34. Cam 32 is freely pivotable between a first position and a second position. In the first position, cam 32 rests against a stop 39 on housing 20 which holds the tip in a position closely adjacent the confronting face of finger 28. In the second position the arm is pivoted away from the tip 38 of finger 28 and thus away from the confronting face of finger 28, as hereinafter explained. In the second position, curved face 35 encounters a pliant stop pad 41 across its path. The stop pad 41 may serve as a bias toward the first position. Otherwise the force of gravity provides sufficient bias to return the cam 32 to the first position.

The finger 28 includes a tooth 43 extending from the cam confronting the face. The finger includes a tapered ramp face 45 on the side nearer the finger head 38. The tip of tooth 43 overlaps cam 32 when it is in its first position.

Ramp 45 provides a runway which in cooperation with cam 32 laterally displaces finger 28 to pluck a string, as illustrated sequentially by FIGS. 8 through 12.

The plectrum operates as follows.

Figure 9:
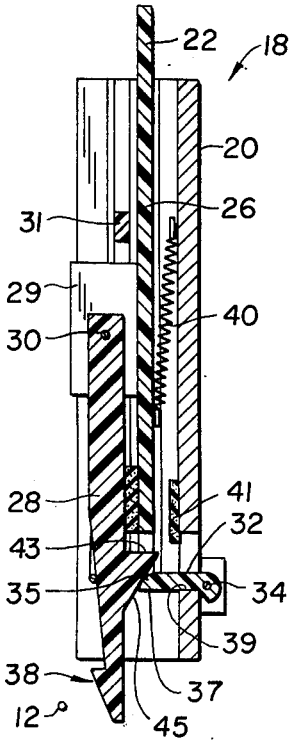
FIG. 9 is a side cross-sectional view of the second embodiment in a second position.
Figure 10:
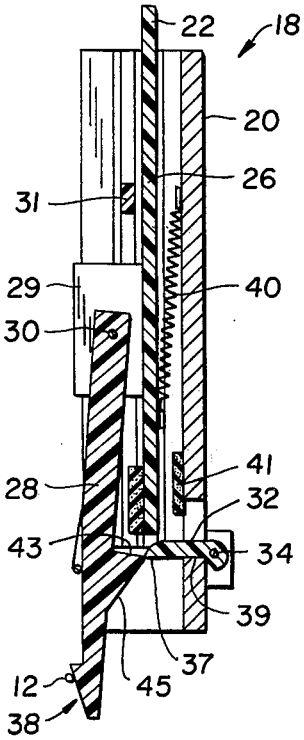
FIG. 10 is a side cross-sectional view of the second embodiment in a third position.
Figure 11:
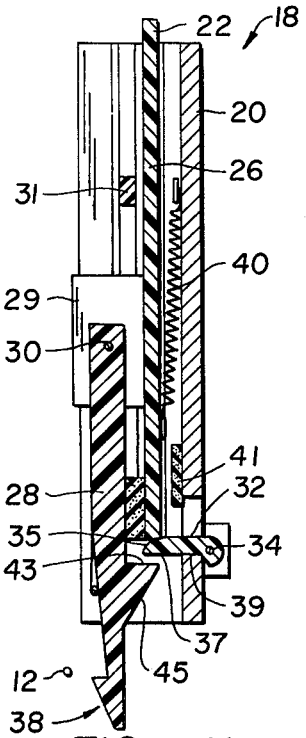
FIG. 11 is a side cross-sectional view of the second embodiment in a fourth position.
Figure 12:
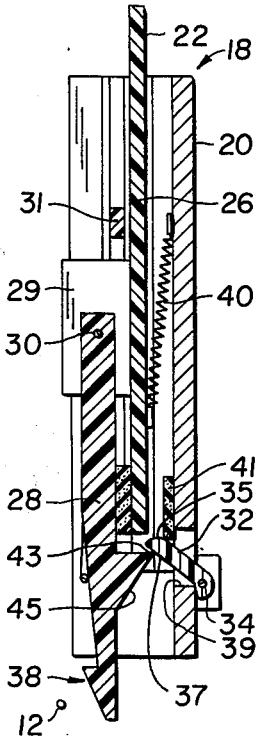
FIG. 12 is a side cross-sectional view of the second embodiment in a fifth position.

In FIG. 8 finger 28 is urged downward so that ramp 45 encounters tapered face 35 of cam 32 in its first position. In FIG. 9, finger 28 is displaced laterally and downwardly toward string 12. In FIG. 10, after head 38 has engaged string 12, the tooth 43 drops past cam 32, following through to a position retracted laterally away the string 12 in line with carriage 26 (FIG. 11). The carriage 26 is then returned to its retracted position. As carriage 26 returns, tooth 43 again engages cam 32, which is free to pivot with the retraction movement of finger 28, finger 28 being sufficiently biased to force displacement of cam 32 by tooth 43. Finger 28 is thus drawn past, i.e., under, string 12 without interfering with its free vibration. The cycle is completed when carriage 26 returns to the position of FIG. 8.

Having thus explained the invention it will be apparent that modifications can be made by the invention by persons of ordinary skill in the art without departing from the true scope of the invention. It is therefore intended that the invention be limited only as indicated by the appended claims.

I claim:

1. For use in a multiple string musical instrument, a plurality of plucking means arranged in an array across said instrument with each plucking means adjacent a string corresponding thereto, each said plucking means comprising:

a housing;

a carriage guide within said housing;

a carriage mounted within said carriage guide and disposed for movement transverse to said string between a first rest position and a second stroke position;

a finger pivotally mounted at a first end to said carriage, said finger being biased against said carriage;

a head at the end of said finger opposing said first end for engaging said string;

a cam follower attached to said finger and extending laterally therefrom; and a cam pivotally mounted to said housing, said cam having a face portion disposed to intercept said follower upon movement from said first to second position for laterally offsetting said finger from said carriage, said cam being further pivotable between a first rest position and a second nonrest position; said carriage in said first position being operative to urge said follower toward said face portion including a corner permitting a lateral return displacement upon movement of said carriage toward said stroke position, and said cam being movable to said second cam position only upon encounter with said follower upon movement of said carriage from said stroke position to said carriage rest position whereby said head is moveable in an eccentric path for stroking a string and permitting free vibration of said string thereafter.

2. An apparatus according to claim 1 wherein said cam comprises a leaf, said follower comprises a pin and said leaf extends laterally from said housing pivot on an axis parallel with said finger into a path for engaging said pin.

3. An apparatus according to claim 2 further including a second identical cam and pin disposed on the laterally opposing side of said finger.

4. An apparatus according to claim 1 wherein said head comprises a tip and a heel having a pliant face, said head being disposed at an angle with the heel laterally further from said carriage than the tip.

5. Apparatus according to claim 4 wherein said finger includes means defining a recess adjacent said heel and along the length of said finger.

6. An apparatus according to claim 1 wherein said cam comprises an arm pivotally mounted to said housing and said follower comprises a tooth extending laterally of said finger, said tooth having a ramp face disposed to intercept said cam and to laterally displace said finger during movement thereof toward said stroke position, and wherein said cam is displaceable upon encounter with said tooth upon movement of said finger between said stroke position and said finger rest position.

7. For use in a multiple string musical instrument, a plurality of plucking means arranged in an array across said instrument with each plucking means adjacent a string corresponding thereto, each plucking means comprising:

a housing;

a carriage guide within said housing;

a linear carriage mounted for linear movement within said housing between a first carriage rest position and a second stroke position;

a finger pivotally mounted adjacent a first end to said carriage and including bias means for drawing said finger toward a finger rest position displaced away from said string;

an obliquely faced head at a second end of said finger opposing said first end, said head being disposed away from said carriage;

means in said finger defining a recess adjacent said head between said first and second ends;

a cam pivotally mounted to said housing, said cam comprising an arm having an obverse tapered face and a reverse flat face, said cam being moveable between a first rest position adjacent said finger and a second nonrest position displaced away from said finger and from said finger head relative to said first cam position;

a cam follower integral with said finger and extending laterally therefrom in position for engaging said cam, said follower comprising a tooth having a ramp face disposed to engage sid cam tapered face for laterally displacing said finger upon movement toward said stroke position, said tooth further including a flat face opposite said ramp face for engaging said cam flat face to urge said cam toward said cam nonrest position without lateral displacement of said finger during movement from said stroke position to said carriage rest position.

* * * * *

UNITED STATES PATENT OFFICE

CERTIFICATE OF CORRECTION

Patent No. 4,120,227 Dated October 17, 1978

Inventor(s) Jaime A. Bolanos

It is certified that error appears in the above-identified patent and that said Letters Patent are hereby corrected as shown below:

The drawing figure which appears on the title page should be deleted and substituted with the attached drawing figure therefor.

Signed and Sealed this

*Third* Day of *April 1979*

[SEAL]

*Attest:*

RUTH C. MASON
*Attesting Officer*

DONALD W. BANNER
*Commissioner of Patents and Trademarks*

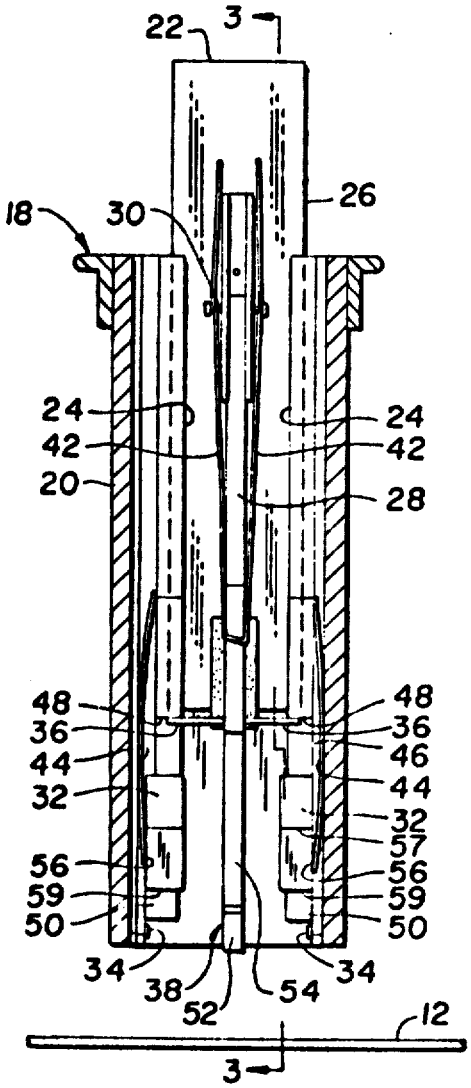
22
3
26
18
30
24
24
42
42
20
28
48
48
36
36
44
46
32
44
32
57
56
56
59
59
50
50
34
34
38
52
54
12
3